United States Patent [19]

Tegart

[11] Patent Number: 4,696,474

[45] Date of Patent: Sep. 29, 1987

[54] GOLF COURSE

[76] Inventor: Harold G. Tegart, 9147 Foothill Blvd., Sunland, Calif. 91040

[21] Appl. No.: 814,601

[22] Filed: Dec. 30, 1985

Related U.S. Application Data

[63] Continuation-in-part of Ser. No. 431,567, Sep. 30, 1982, Pat. No. 4,572,512.

[51] Int. Cl.[4] ..... A63B 69/36

[52] U.S. Cl. ..... 273/176 A; 273/186 R; 273/181 R; 273/DIG. 28

[58] Field of Search ..... 273/176 R, 176 A, 176 AA, 273/176 AB, 176 E, 176 FA, 176 FB, 176 L, 186 RA, DIG. 28, 185 A, 181 A

[56] References Cited

U.S. PATENT DOCUMENTS 4,572,512 2/1986 Tegart ..... 273/176 A

*Primary Examiner*—George J. Marlo

*Attorney, Agent, or Firm*—John E. Wagner

[57] ABSTRACT

A compact golf course which employs a number of tee positions facing a series of targets at ranges up to 300 yards with distance indicators whereby a player at one of the tees can drive tee and fairway shots and record precisely the distance attained on each shot. Chipping greens are provided. Putting greens are provided for the putting phase of the golf game. The golfer moves in sequence from the tee and fairway target range to the chipping range and the putting greens. Score cards are provided and layouts and pars and distances of famous courses appear on charts located at each tee position to allow the player to play in sequence the holes of the selected famous course. Closed circuit television cameras are located on the fairway driving range portion of the course directed toward the tees. A television monitor and a camera selector switch are located at each tee position so that the golfer may select a particular camera scene to be viewed on the television monitor. Player actuated lighted signs over each tee viewable by the television camera are provided. An improved method of scoring provides a permanent record of distance and efficiency of each golf shot in progress, not just the number of strokes per hole as in conventional golf.

13 Claims, 22 Drawing Figures

THE CHIPPING AND PITCHING APEA, PPO-SHOP AND CLUB HOUSE LOCATED AT ADJACENT SELECTED APEA.

SELECT A

SELECT B

SELECT C

FRONT OF SCORE CARD

FOLD LINE

GOLF-By GEORGE! NAME OF PROMINANT COURSE SELECTED.

| G-ByG | HOLE Nº | 1 | 2 | 3 | 4 | 5 | 6 | 7 | 8 | 9 |
|---|---|---|---|---|---|---|---|---|---|---|
| | PAR STROKES OF SELECTED COURSE | | | | | | | | | |
| PAR YARDS OF THE SELECTED COURSE | | | | | | | | | | |
| TEE OFF YARDS HIT | | | | | | | | | | |
| TARGET YARDS | | | | | | | | | | |
| 2nd STROKE YARDS HIT | | | | | | | | | | |
| TARGET YARDS | | | | | | | | | | |
| 3rd STROKE YARDS HIT | | | | | | | | | | |
| TARGET YARDS | | | | | | | | | | |
| OFF GREEN YARDS TO PIN | | | | | | | | | | |
| ON GREEN FEET TO PIN | | | | | | | | | | |
| ADDITIONAL Nº OF PUTTS | | — | — | — | — | — | — | — | — | — |
| STROKES & PENALTIES= TOTAL | | | | | | | | | | |

DRIVER 'A';3 WOOD 'B';4 WOOD 'C';5 WOOD 'D'; PITCHING WEDGE 'P'; SAND WEDGE 'W'

TOTALS: 9 HOLES ½ HANDICAP: NET SCORE: FAIRWAYS HIT: GREENS HIT:

GOLFER: ATTESTER: DATE: Nº OF PUTTS:

© H. GEORGE TEGART

LEGEND

FAIRWAY HIT

CLUB

Nº OF PUTTS

Fig. 17

Fig.18

BACK OF SCORE CARD

GOLF-By GEORGE!

| HOLE Nº / PAR STROKES OF SELECTED COURSE | 10 | 11 | 12 | 13 | 14 | 15 | 16 | 17 | 18 |
|---|---|---|---|---|---|---|---|---|---|
| PAR YARDS OF THE SELECTED COURSE | | | | | | | | | |
| TEE OFF YARDS HIT | | | | | | | | | |
| TARGET YARDS | | | | | | | | | |
| 2nd STROKE YARDS HIT | | | | | | | | | |
| TARGET YARDS | | | | | | | | | |
| 3rd STROKE YARDS HIT | | | | | | | | | |
| TARGET YARDS | | | | | | | | | |
| OFF GREEN YARDS TO PIN | | | | | | | | | |
| ON GREEN FEET TO PIN | | | | | | | | | |
| ADDITIONAL STROKES & PENALTIES / Nº OF PUTTS | — | — | — | — | — | — | — | — | — |

DRIVER 'A'; 3 WOOD 'B'; 4 WOOD 'C'; 5 WOOD 'D'; PITCHING WEDGE 'P'; SAND WEDGE 'W'

TOTALS: 9 HOLES: ½ HANDICAP: NET SCORE: FAIRWAYS HIT: GREENS HIT:

TOTALS: 18 HOLES: HANDICAP: NET SCORE: FAIRWAYS HIT: GREENS HIT: Nº OF PUTTS

© H. GEORGE TEGART

GOLF-B GEORGE! NAME OF PROMINANT COURSE SELECTED: PEBBLE BEACH

| G-BYG HOLE Nº / PAR STROKES OF SELECTED COURSE | 1 / 4 | 2 / 5 | 3 / 4 | 4 / 4 | 5 / 3 | 6 / 5 | 7 / 3 | 8 / 4 | 9 / 4 |
|---|---|---|---|---|---|---|---|---|---|
| PAR YARDS OF THE SELECTED COURSE | 385 | 507 | 368 | 325 | 180 | 515 | 120 | 425 | 450 |
| TEE OFF YARDS HIT | B 170 | D 192 | D 161 | D 162 | C 173 | D 183 | 9 127 | D 204 | D 193 |
| TARGET YARDS | 225 | 315 | 225 | 175 | | 332 | | 225 | 275 |
| 2nd STROKE YARDS HIT | B 183 | B 178 | B 181 | 4 167 | | 8 169 | | W B 163 | S B 168 |
| TARGET YARDS | | 150 | | | | 175 | | 75 | 125 |
| 3rd STROKE YARDS HIT | | 158 | | | | 4 | | P 79 | P |
| TARGET YARDS | | | | | | 178 | | | |
| OFF GREEN YARDS TO PIN | 42 | | 44 | 22 | 43 | | | 39 | |
| ON GREEN FEET TO PIN | | 24 | | | | 17 | 28 | | 14 |
| ADDITIONAL STROKES & PENALTIES / Nº OF PUTTS | 2 / 5 | 3 / 6 | 3 / 6 | 3 / 6 | 3 / 6 | 2 / 5 | 3 / 6 | 2 / 7 | 2 / 6 |

DRIVER 'A'; 3 WOOD 'B'; 4 WOOD 'C'; 5 WOOD 'D'; PITCHING WEDGE P SAND WEDGE W

TOTALS: 9 HOLES: 52 ½ HANDICAP: 16 NET SCORE: 72 FAIRWAYS HIT: 5 GREENS HIT: 4

GOLFER: ROBERTS ATTESTER: JENSEN DATE: 4/15/85 Nº OF PUTTS: 23

LEGEND

FAIRWAY HIT

CLUB

Nº OF PUTTS

© H. GEORGE TEGART

Fig. 19

GOLF-By GEORGE! RECORD OF IMPROVEMENT BY:

| G-By G DATE: | JAN | FEB | MAR | APRIL | MAY | JUNE |
|---|---|---|---|---|---|---|
| 4 WOOD LONGEST DIST. HIT YDS | | | | | | |
| AVERAGE Nº OF FAIRWAYS HIT IN 18 HOLES | | | | | | |
| " " GREENS " " | | | | | | |
| 3 WOOD LONGEST DISTANCE HIT (YDS) | | | | | | |
| AVERAGE Nº OF FAIRWAYS HIT IN 18 HOLES | | | | | | |
| " " GREENS " " | | | | | | |
| DRIVER LONGEST DISTANCE HIT (YDS) | | | | | | |
| AVERAGE Nº OF FAIRWAYS HIT IN 18 HOLES | | | | | | |
| " " GREENS " " | | | | | | |
| MINIMUM Nº OF PUTTS IN 18 HOLES | | | | | | |
| AVERAGE Nº OF " " " | | | | | | |
| 7 IRON LONGEST DISTANCE HIT (YDS) | | | | | | |
| AVERAGE DISTANCE REACHED (YDS) | | | | | | |
| 5 IRON LONGEST DISTANCE HIT (YDS) | | | | | | |
| AVERAGE DISTANCE REACHED (YDS) | | | | | | |

© H. GEORGE TEGART

Fig. 20

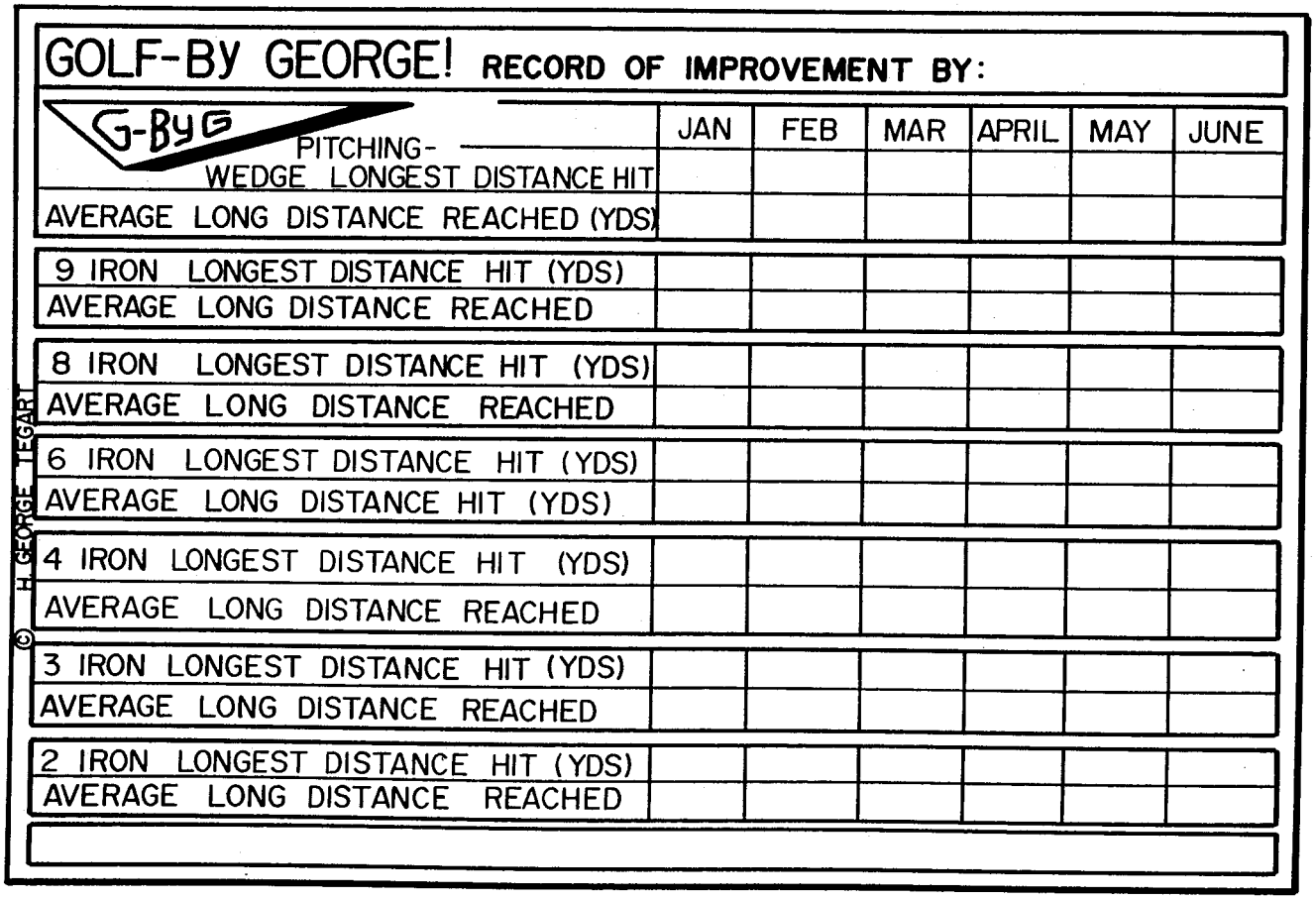

GOLF-BY GEORGE! RECORD OF IMPROVEMENT BY:

G-BYG

| | JAN | FEB | MAR | APRIL | MAY | JUNE |
|---|---|---|---|---|---|---|
| PITCHING-WEDGE LONGEST DISTANCE HIT | | | | | | |
| AVERAGE LONG DISTANCE REACHED (YDS) | | | | | | |
| 9 IRON LONGEST DISTANCE HIT (YDS) | | | | | | |
| AVERAGE LONG DISTANCE REACHED | | | | | | |
| 8 IRON LONGEST DISTANCE HIT (YDS) | | | | | | |
| AVERAGE LONG DISTANCE REACHED | | | | | | |
| 6 IRON LONGEST DISTANCE HIT (YDS) | | | | | | |
| AVERAGE LONG DISTANCE HIT (YDS) | | | | | | |
| 4 IRON LONGEST DISTANCE HIT (YDS) | | | | | | |
| AVERAGE LONG DISTANCE REACHED | | | | | | |
| 3 IRON LONGEST DISTANCE HIT (YDS) | | | | | | |
| AVERAGE LONG DISTANCE REACHED | | | | | | |
| 2 IRON LONGEST DISTANCE HIT (YDS) | | | | | | |
| AVERAGE LONG DISTANCE REACHED | | | | | | |

© H GEORGE TEGART

Fig. 21

GOLF COURSE

REFERENCE TO RELATED APPLICATIONS:

This is a continuation-in-part of my patent application, Ser. No. 431,567 and filed Sept. 30, 1982, and issued as U.S. Pat. No. 4,572,512.

BACKGROUND OF THE INVENTION

With the overcrowded conditions of conventional golf courses, the expense of play and the time required to play a round of golf, a number of people have recognized the need for providing a compact form of golf course which is less expensive due to use of less land, allows multiple players to speed up the time and as a result of the two, reduces the cost to the golf player. A number of patents have been issued for compact golf courses which include the following:

| U.S. Pat. No. | Issued | Inventor |
|---|---|---|
| 3,129,943 | April 21, 1964 | McKee |
| 3,310,310 | March 21, 1967 | McKee |
| 3,464,703 | Sept. 2, 1969 | Vallas |
| 3,685,832 | Aug. 22, 1972 | Johnson |
| 3,904,209 | Sept. 9, 1975 | Thomas |
| 3,999,764 | Dec. 28, 1976 | Nitsche |
| 4,019,748 | April 26, 1977 | Healey |
| 4,063,738 | Dec. 20, 1977 | Michalson |
| 4,129,300 | Dec. 12, 1978 | Magnuson |
| 4,192,510 | March 11, 1980 | Miller |
| 4,283,056 | Aug. 11, 1981 | Miller |

Each of these patents disclose golf courses requiring significantly less ground than a standard golf course, and often to varying degrees appear to achieve the objective of faster play and reduced cost.

It would appear from the study of these patents that many of them go to a great extent to simulate play of the golf course and may attempt to provide an atmosphere of isolation through the use of natural and artificial barriers between player tees providing a degree of simulation of play of a conventional golf course. While a number of these objectives have been attained, at least partially, the compact golf course has not reached any significant acceptance in the golf community as noted by their absence from the modern day golf scene. In a typical metropolitan area, one will find public and private full size golf courses, par three or reduced yardage golf courses and driving ranges but this inventor has yet to see a single operating compact golf course of the type disclosed in the above patents.

In my parent application referenced above, several patents were referenced relative to various forms of golf courses and swing actuated training devices. They include:

| U.S. Pat. No. | Issued | Inventor |
|---|---|---|
| 1,851,423 | March, 1932 | Ely |
| 2,003,074 | May, 1935 | Gage |
| 2,248,053 | July, 1941 | Bales |
| 3,216,726 | Nov., 1965 | Anderson et al |
| 3,314,679 | April, 1967 | Kolln |
| 3,820,133 | June, 1974 | Adorney et al |

Recognizing the continuing need for compact golf courses and after further study of the features of the several disclosures, this inventor finds that his basic concept provides features not present in any prior compact golf course designs and in fact provides a game of golf which is superior in a number of respects to the conventional golf game.

For a compact course to function successfully and with enthusiastic public acceptance, since all fairway shots are made from the player's one single tee, and since with a compact course he can't go out to where he has hit the ball and appraise the remaining play from there, it becomes essential for the player to know accurately how far he has advanced the ball. This basic essential requirement is readily recognized when you try to visualize, from an eye level of five and one half feet, accurately determining the distance to a one and one half inch diameter ball as distant as the combined length of up to two to three football fields. Another analogy—seeing the accurate distance to a ball as far away as between two to three times the distance between home plate and the outfield fence of a baseball field; or to see its location between horizontal lines, which at that distance and angle have no distinction between them. Until my invention, herein set forth, means for accurately knowing at the tee location, the distance of long hit balls has not been effectively made a part of golf.

The need for a solution to this problem was emphasized unsuccessfully in the prior art by Gage way back fifty years ago. In his U.S. Pat. No. 2,003,074, he calls for a boy to sit on a tall pole and call back to the player the distance hit. This was not successful, particularly when there were multiple tees. The boy would be yelling his head off as well as distracting the other players. Also, if two players at different tees hit simultaneously, the boy would have a problem. The solution is provided by this inventor using closed circuit television and a supplemental device, neither of which are found in any of the prior art.

In the prior patents, fairway targets were shown raised to provide some means of seeing long hit balls. This was inadequate. It also blocked the view to balls hit beyond the raised targets. However, it again emphasized the need for adequate means of seeing accurately the true distance of long hit balls.

This prior art does not disclose any closed circuit television aid in which the tees each have associated therewith an illuminatable tee sign and one or more television cameras are located down field and directed towards the tees. None have a switch actuated by the player's swing which serves to illuminate the tee number sign so that the player, as he completes his swing, can look at the television monitor and immediately pick out his tee location by viewing the illuminated tee number sign as seen by the television cameras. It is therefore easier for him to pick out and follow his ball in flight knowing its source location, namely his own tee, on the monitor screen.

Also, with the golfer's continuing desire to improve his ball striking ability, he has lacked an aid not provided in the previous patents, that is, to know with reliable accuracy how far he has hit a ball each time with the same club, and have means of recording same, and then he can pinpoint improvement. The composite of my invention provides this aid.

Also, previous inventors have not made provision for comparable multiple chipping and pitching and putting greens with sand trap play which are introduced as component parts of my invention, and greatly increase play capacity.

This prior art does not disclose any comparable simplified, maintenance free water hazard arrangement for retrieving golf balls from the water hazard, as is provided for in my subject invention, which resolves past attempts in the previous patents, going back many years of complicated mechanical devices that proved to be impractical.

None of the above disclose a double ended golf course using the same area for two oppositely directional courses.

BRIEF DESCRIPTION OF THE INVENTION

This inventor has, he believes, eliminated some of the inherent weakness in the prior attempts to attain a satisfactory compact golf course and to provide a more interesting play than even conventional golf. He employs a generally rectangular course of varying dimensions and having as a typical size 100 yards in width by 400 yards in length, exclusive of service, club house and parking areas. The layout is generally rectangular which makes it most adaptable to available real estate but is not limited to such a shape. The layout includes a number, for example 20 tees, each directed toward a fairway of at least 300 yards in length and 100 yards in width. A number of yardage indicators which may be in the form of yard lines are provided as well as targets at varying ranges from 50 to 300 yards from the tees. The targets may take the form of simulated green and pin. Hazards and rough areas on the fairway are provided and an out-of-bound line on each side of the fairway is present. Within short walking distance in back of the tees are a plurality of chipping or pitching greens with arcuate lines defining varying distances from the pitching green, namely 50 to 20 yards. One or more putting greens are also provided. A number of television cameras are directed at the fairway allowing the player to follow and locate his ball in flight and on landing to determine the ball's relation to the fairway yardage lines in order to properly record its range. A television monitor is located at each tee for viewing by players in observing their balls. For night play, in addition to overall lighting, there is enhanced lighting to aid television detection of the balls in flight.

An improved water hazard is also disclosed as well as an improved tee station.

I have further determined that the closed circuit television aid for the players is enhanced when the television cameras are located at the end of the course, directed toward the fairway and tees, and each of the tees has a large tee number sign with the tee's number associated therewith, which is illuminated responsive to the golfer's swing. The course, the ball in flight and the illuminated tee number sign is visible on the closed circuit television monitor located at the tee.

I have also developed an alternate form of course which further increases the playing capacity, employing in the order of twenty or more putting greens and ten or more chipping and pitching greens, arranged in parallel array but with contouring when desired.

I have further disclosed and claimed a double ended course allowing double the amount of play on a non-interference basis.

In accordance with the method of this invention, the player is given a number of distinctive balls sufficient for a round of nine or eighteen holes. He selects a particular course which, from a brochure of prominent courses, he intends to select one to simulate playing. The player drives his first tee shot and records the distance attained and any penalty if he enters a trap or lands out of bounds. He substrates the yardage attained from the yardage remaining on a hole of his selected course and then takes his second or fairway shot, and again subtracts the yardage attained from the remaining yardage to that hole. When he reaches 50 yards or less from the hole, but does not hit onto the target green, he moves to the chipping green at the appropriate distance on the arcuate line play areas and chips or pitches to the green, recording each shot numerically. If he lands on the target green in his fairway play, he moves to one of the putting greens to putt out and records his play for the hole. He and his playing partners return to the tee reserved for them and proceed to play the next hole in like manner. The play may be by a foursome, threesome, pair or single player without affecting performance. The scorecard reflects not only the number of strokes required for each hole but also the yardage and quality of shot obtained for each fairway club used, and the number of putts. Alternate embodiments involve a double ended course and a trapezoidal shaped course.

The method of this invention involves the use of novel scorecards which allow the player to select one from a number of prominent courses, complete the par value and yardage of each course hole and record the clubs used and his own performance on each stroke for later analysis and comparison with previous rounds. The completed scorecard therefore provides a rather complete record of each round and a basis for analysis of his game development.

BRIEF DESCRIPTION OF THE DRAWING

This invention may be more clearly understood from the following detailed description and by reference to the drawing in which:

FIG. 17 is the front of a scorecard particularly designed for this invention;

FIG. 18 is the back thereof;

FIG. 19 is the front of a completed scorecard; and

FIGS. 20 and 21 are views of the front of performance record cards for use with this invention.

DETAILED DESCRIPTION OF THE INVENTION

Figure 1:
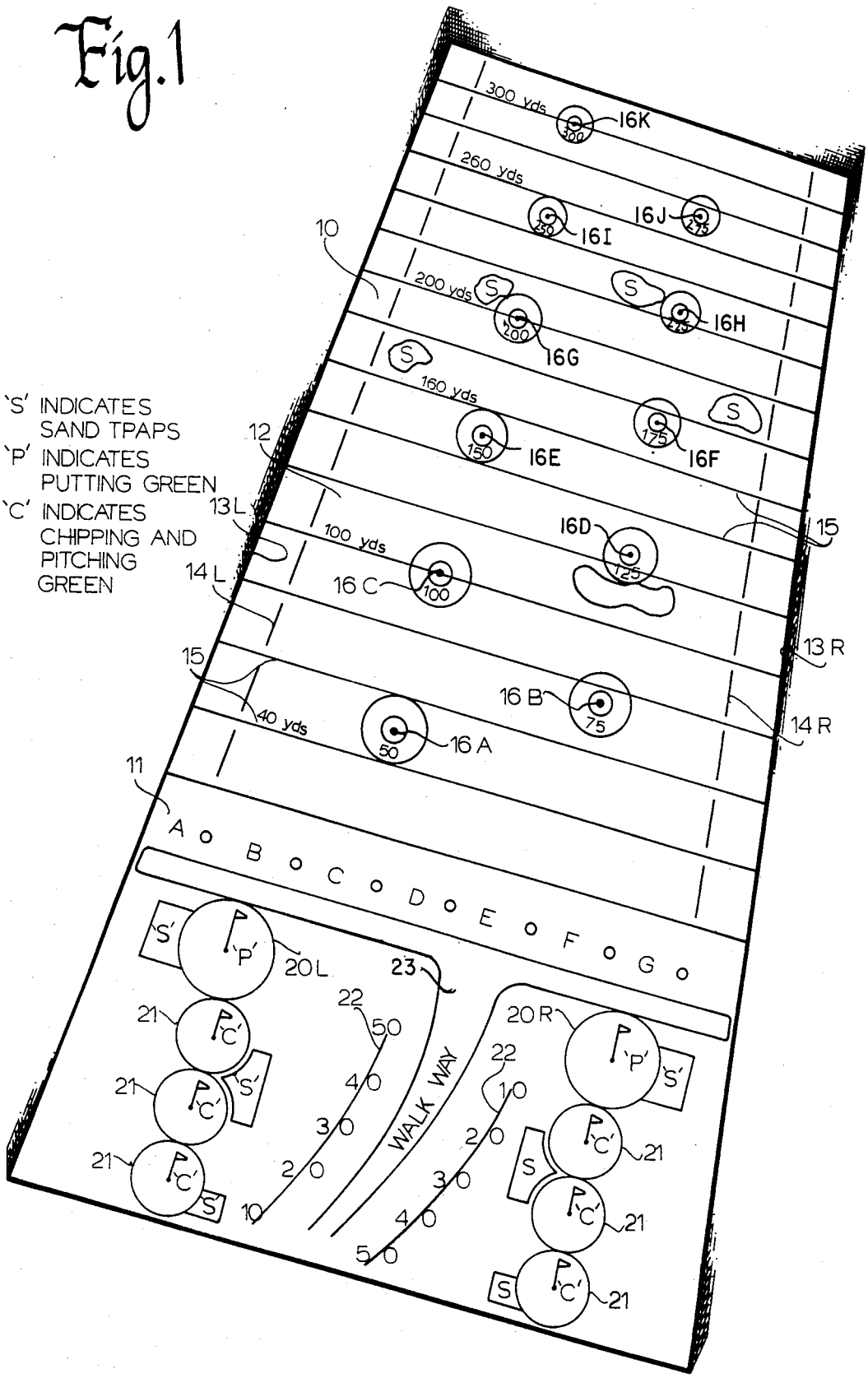
FIG. 1 is a perspective view of a compact golf course in accordance with this invention.

Now for a clear understanding of this invention, attention is directed toward FIG. 1 which provides somewhat of an aerial view of the basic elements of this invention including club house, service area and parking. The compact golf course in accordance with this invention, generally designated 10, comprises a tee area 11 including a number of individual tees designated A–G for convenience. The tees face a fairway generally designated 12 including perimeter fences denoted by lines 13L and 13R, and out of bound lines 14L and 14R. We have a number of yardage indicators shown for convenience as yardage lines 15, preferably located at 20 yard intervals from the tees 11. Also present in the fairway are a plurality of targets 16A through 16K. The targets are shown as being 11 in number, however there is nothing critical about the particular number or location of the targets other than that they are at varying distances from the tees in the fairway. A number of sand traps designated S, and one or more water hazards designated W, are present in the fairway to provide natural hazards in play. The rough strips designated in FIGS. 2A and 3 as ROUGH region is preferably mowed at a higher level than the fairway to accurately represent rough.

In FIG. 1 shown adjacent to the tees 11 but located at any place in the region to the rear of the tees are a pair of putting greens 20L and 20R designated by the letters P and a number of chipping or pitching greens 21 designated by the letter C. The chipping or pitching greens 21 are preferably located at the side perimeter of the course. Between the chipping and pitching greens 21 to the left and 21 to the right in FIG. 1 is a central walkway 23 from the tee area along a curved arc and a number of chipping or pitching positions 22 at varying distances from the several, for example, 6 chipping greens 21. The arcuate curved chipping or pitching lines 22 allow the players to position themselves at any correct distance from the chipping or pitching pin corresponding to the remaining distance after the last fairway shot. If the remaining distance is about 43 yards, the player positions himself along either of the arcuate lines, slightly closer to the 40 indicator than the 50 yard mark. The large number of chipping or pitching greens and the continuously variable chipping distances allows a number of players to chip or pitch simultaneously without interfering with each other. Adjacent to the chipping or pitching greens 21 are the putting greens 20L and 20R, either of which the player may use. As shown in FIG. 1, the putting greens are located near the tees 11 as is usually found in conventional full courses, but the location of the greens may be moved to accommodate the particular terrain in which the course is located.

Figure 2:
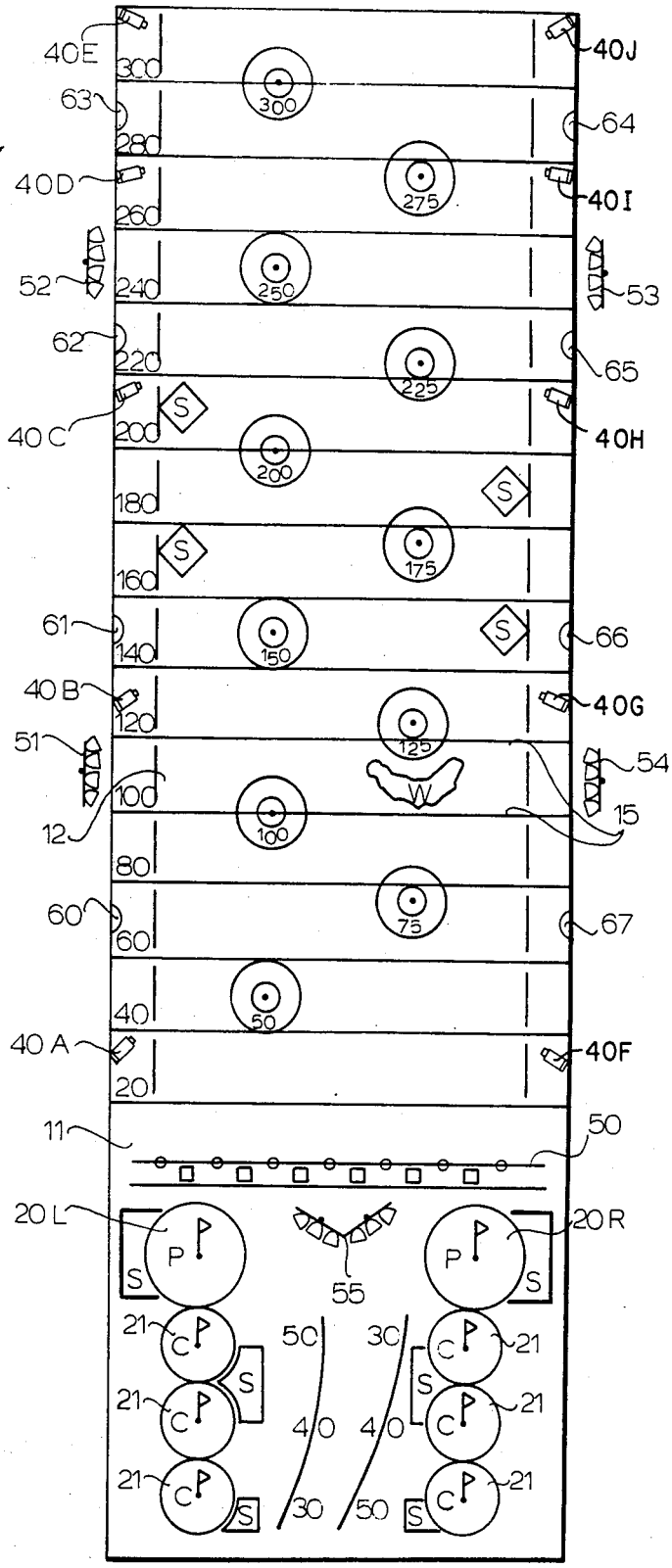
FIG. 2 is a plan view thereof.
Figure 2A:
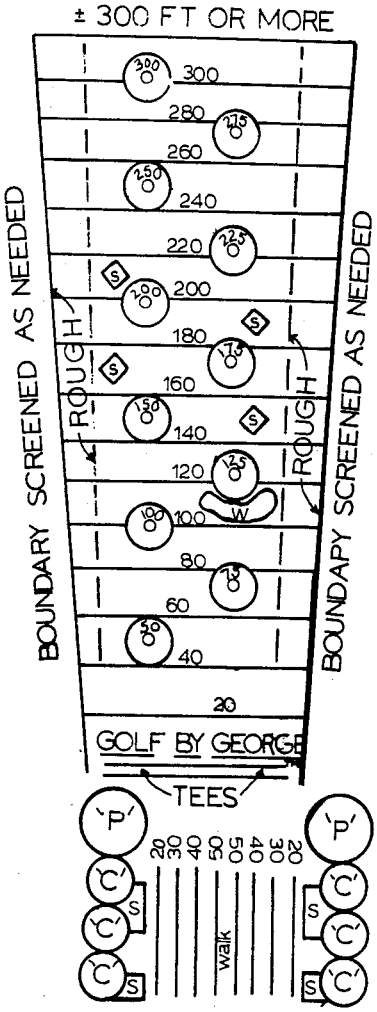
FIG. 2A is a plan view of an alternate trapezoidal embodiment of this invention.

Now referring to FIG. 2, two other aspects of this invention may be seen. In addition to the tees 11, yardage lines 15 and greens 20 and 21, the fairway targets 16A–K may be seen more clearly. They each include a pin or flag and are located at 25 yard range intervals from the tee line 11. The target greens 16 are 20 to 40 yards in radius and include an outer circle of a 10 yard radius and an inner circle of 3 yards.

Certain other features of this invention may also be seen in FIG. 2. A number of closed circuit television cameras 40A–J are located at the perimeter of the course 10 with suitable protection from stray balls, and are directed toward the fairway 12. The cameras 40 cover the fairway region and aid the player in picking out his ball, and in accurately determining the distance of each shot. The television cameras give him a closer view to determine accurately the distance he has hit the ball. Said cameras may have zoom capability and in such case, where controls are available to the player, he may have a close-up look at his ball. Since it is the practice of using distinctively marked balls for each player, the identification of a player's ball is even easier with said television cameras. As shown in FIG. 2, a total of 10 television cameras are used but this number may vary depending upon the requirements of the particular course.

Figure 6:
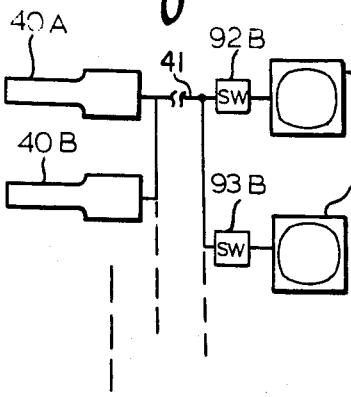
FIG. 6 is a simplified block diagram of the closed circuit television system of this invention.

FIG. 6 shows a simplified block diagram of the television camera and monitor system. The several cameras 40 are all connected by cables 41 to the selector switch 93A at the monitor 92 at each tee. The selector switch 93 at each tee allows players to connect any of the cameras to the local monitor 92 of FIG. 4.

Figure 4:
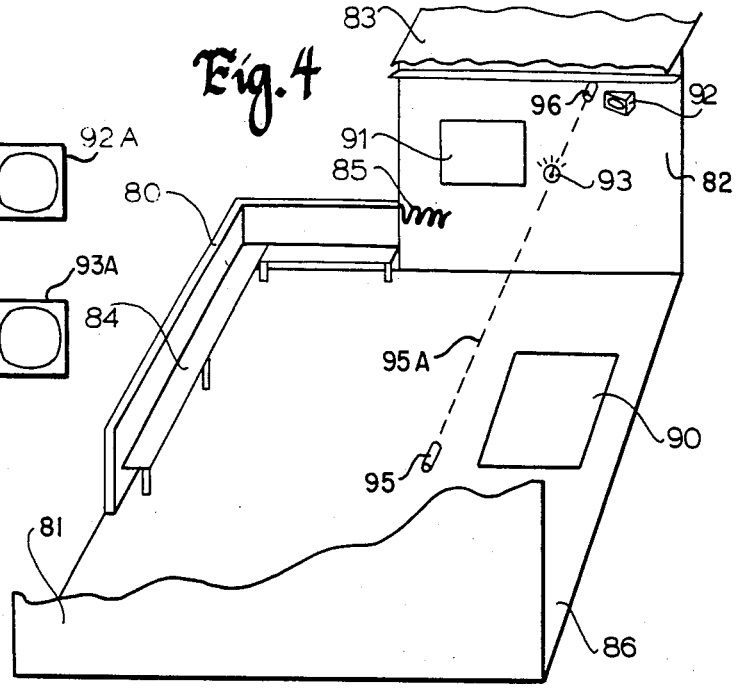
FIG. 4 is a fragmentary perspective view of a single tee.
Figure 7:
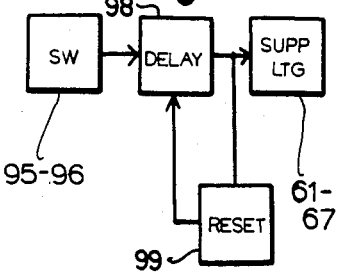
FIG. 7 is a simplified block diagram of the supplemental lighting visual aid of this invention.

FIG. 2 also shows a basic lighting system used for night play and a supplemental play actuated visual and lighting system as shown in FIGS. 4 and 7. The basic lighting system includes drop or fluorescent lighting at each tee designated 50, and banks of elevated flood lights 51–54 directed at the fairway 12, with lights 55 directed at the chipping or pitching and putting greens.

In addition to this basic lighting, a number, for example 8 lights 60–67, are located immediately beside the perimeter of the course and are actuated by play to energize the supplemental lighting whenever a ball is driven.

The lights 60–67 provide the supplemental lighting under the control of the players as is described below.

Figure 3:
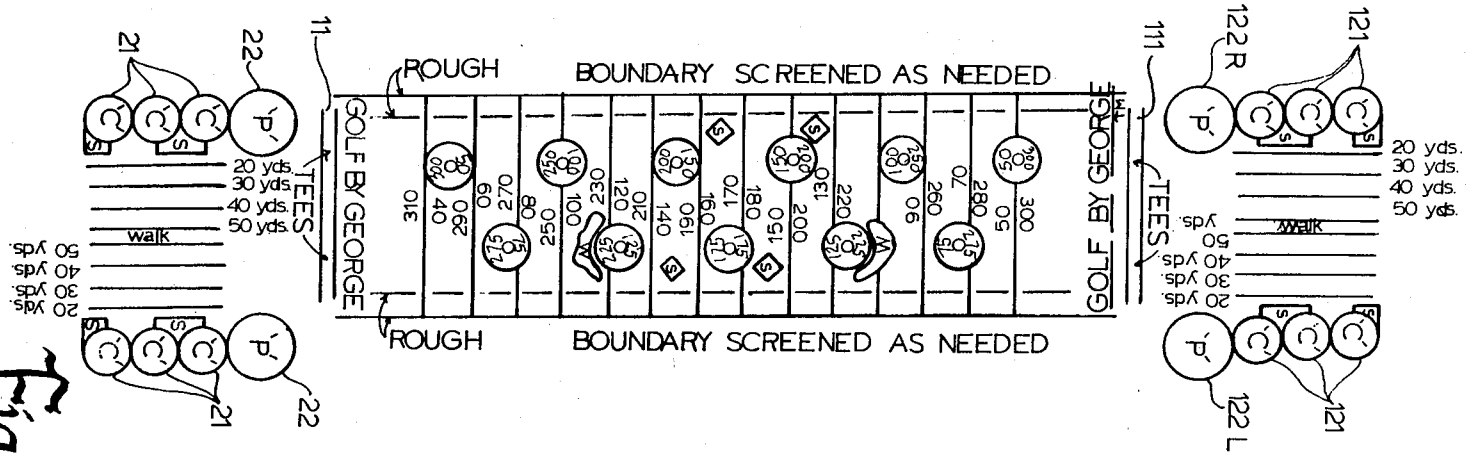
FIG. 3 is an alternate embodiment double ended layout of this invention.

FIG. 3 shows an alternate embodiment of this invention which is double-ended. In FIG. 3 the same or a slightly longer fairway 12 is used than in the case of FIG. 1. This embodiment differs in that an additional set of tees 111, chipping greens 121 and putting greens 122 are present at the opposite end of fairway 12. The fairway range markers 15 bear designations indicating the distance from either end. The targets 16 also bear dual distance designations to be observed by the golfer at the tees and by the cameras.

The double ended course of FIG. 3 may include the television aid of this invention as illustrated in FIGS. 2, 4, 8 and 13. Preferably the television cameras are located at opposite ends of the course adjacent to the tees and directed toward the fairway region. The television cameras at one end are connected as by cables to the monitors at the tees.

This version of my invention, requiring only about 20 percent additional real estate, increases the number of tees by 100 percent. Each of the other features of this invention remain in the embodiment of FIG. 3.

Referring now to FIG. 4, one form of tee may be seen in the form of a booth generally designated 80 including boundary side walls 81 and 82 which form common walls with adjoining tee booths. The booths 80 are preferably covered by a roof 83 for sun and rain protection for the players. A bench 84 is provided for other members of the player's party and rack 85 for golf bags may be present. The front of the booth 80 includes some form of turf 86, either natural or artificial, for fairway shots. It also may receive golf tees for tee shots. A central tee region 90, similar to driving ranges, may be provided, or the entire front area may be of turf.

The booth 80 also includes a course layout board 91, preferably attached to the wall 82, and having a number of large layouts for prominent courses of the world. The players may select the course they wish to simulate play and display the appropriate layout on the wall throughout play. The precision needed to play such courses is simulated in this invention by the targets 16 toward which all tee and fairway shots should be directed. Thus, the presence of targets on the fairway adds a new dimension to the game of golf by providing a value measure for each shot as well as mere range and position. Being able to determine accurately the distance that balls are hit is a principal factor in this game.

I have provided closed circuit television for monitoring the flight and position of the ball. This is in the form of the television cameras 40 A–J of FIG. 2 and the television monitor 92 of FIG. 4. The monitor 92 is located in the booth at an elevated position, out of playing areas and generally available to the player's normal field of view when tracking the flight of his ball. Location of the monitor 92 may, of course, be selected to provide the best view for the players. In FIG. 6, since a number of television cameras 40A–C indicated herein are in operation, a channel selector switch 92B is provided to allow the players to select the appropriate camera. This may be done before taking the shot if the player's shot is predictable, or immediately after the shot while the ball is in flight.

Under conditions of night play, normal lighting may be insufficient to provide a clear image in the television system. In such case the supplemental lighting system of FIG. 2 is energized for a period approximating the longest flight and for sufficient time to follow the roll and clearly identify and locate the player's ball. In its preferred form the play activated switch includes a light source 95 secured overhead to wall 81, and a photo electric cell 96 secured in alignment with the light source on the opposite wall 82. Located overhead above the player's head, the passage of the club through the light path 95A interrupts the light beam and triggers the supplemental lighting just as the player strokes to hit the ball.

The play actuated lighting system appears in FIG. 7. It comprises a play actuated switch 97 in combination with the light source 95 and photocell 96 located in each booth. This switch combination acts through a delay device such as a slow acting relay 98 to light the supplemental lighting system 60–67. After a predetermined period of time, e.g. 16 seconds, a reset circuit 99 extinguishes the supplemental lighting until another golf club swing has again energized the system.

Figure 5:
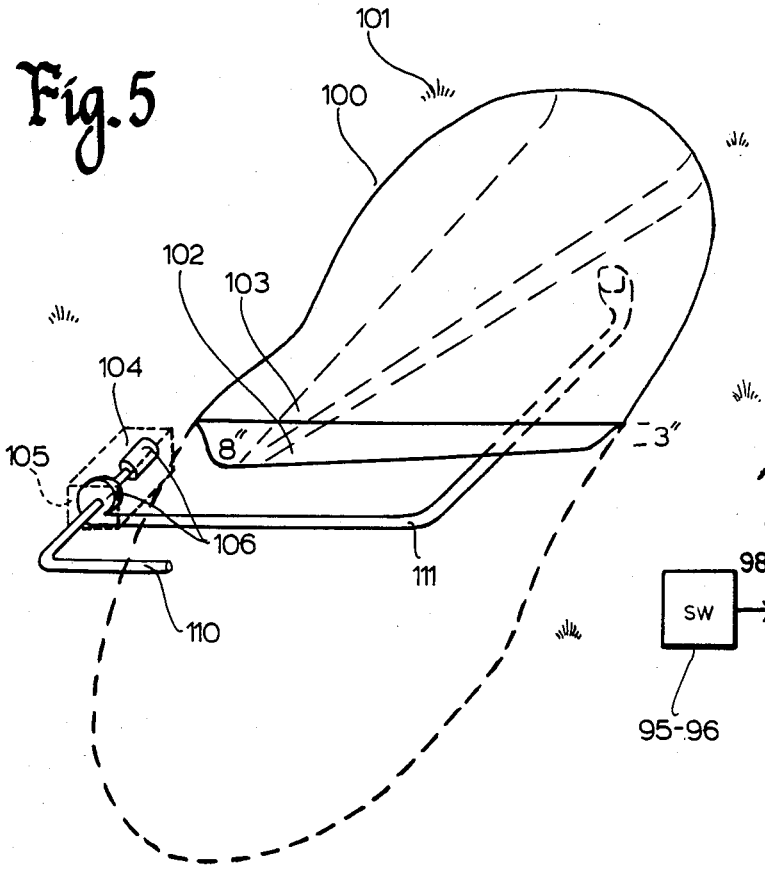
FIG. 5 is a sectioned perspective view of a novel water hazard in accordance with this invention.

FIG. 5 shows an improved form of hazard which is directly applicable to this course or may be used on a conventional course as well. It is a shallow lake water hazard having a solid bottom such as gunite type concrete. The water hazard, generally designated 100, is located in the fairway 101 and gives the same general appearance as a natural water hazard. It is, however, only a few inches deep and has a hard yet resilient bottom 102, preferably of concrete. The depth varies from 3 to 8 inches in my preferred embodiment. The lake or water hazard 100 may be static with just makeup water added to maintain the level of water between 3 and 8 inches in depth, or it may include a recirculating system 104 as disclosed in FIG. 5 including a pump and motor combination in an equipment vault 105 indicated in dashed lines, supply 110 and return 111 lines.

The tapered bottom of the water hazard 100 allows balls which land and remain in the hazard to roll along the bottom to a collection point for ease of recovery. Balls may be easily seen and recovered when the course is not in use, or ball recovery may be made by standard mobile ball retrievers rolling through the hazard to easily recover the balls. The shallow depth and normal bottom visibility allows recovery of the balls in just a few seconds.

When a ball hits the water of a water hazard, the golfer marks "W" on his scorecard when he records the length of that shot, and counts one stroke penalty. His yardage is where his ball hits the water.

Figure 8:
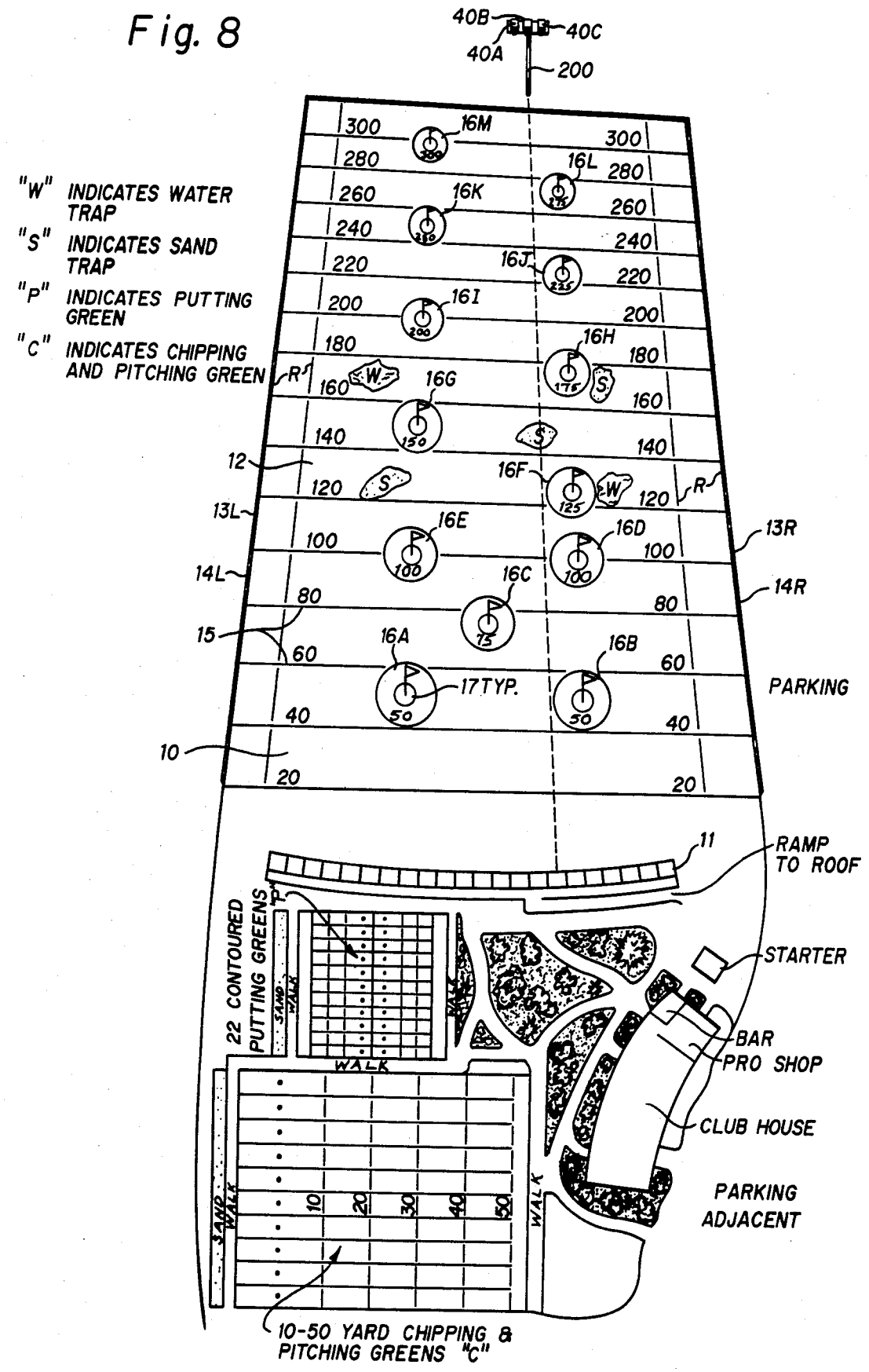
FIG. 8 is a perspective view of an alternate embodiment including a rearranged form of the closed circuit television monitoring, and the chipping and pitching, and putting green layout.
Figure 9:
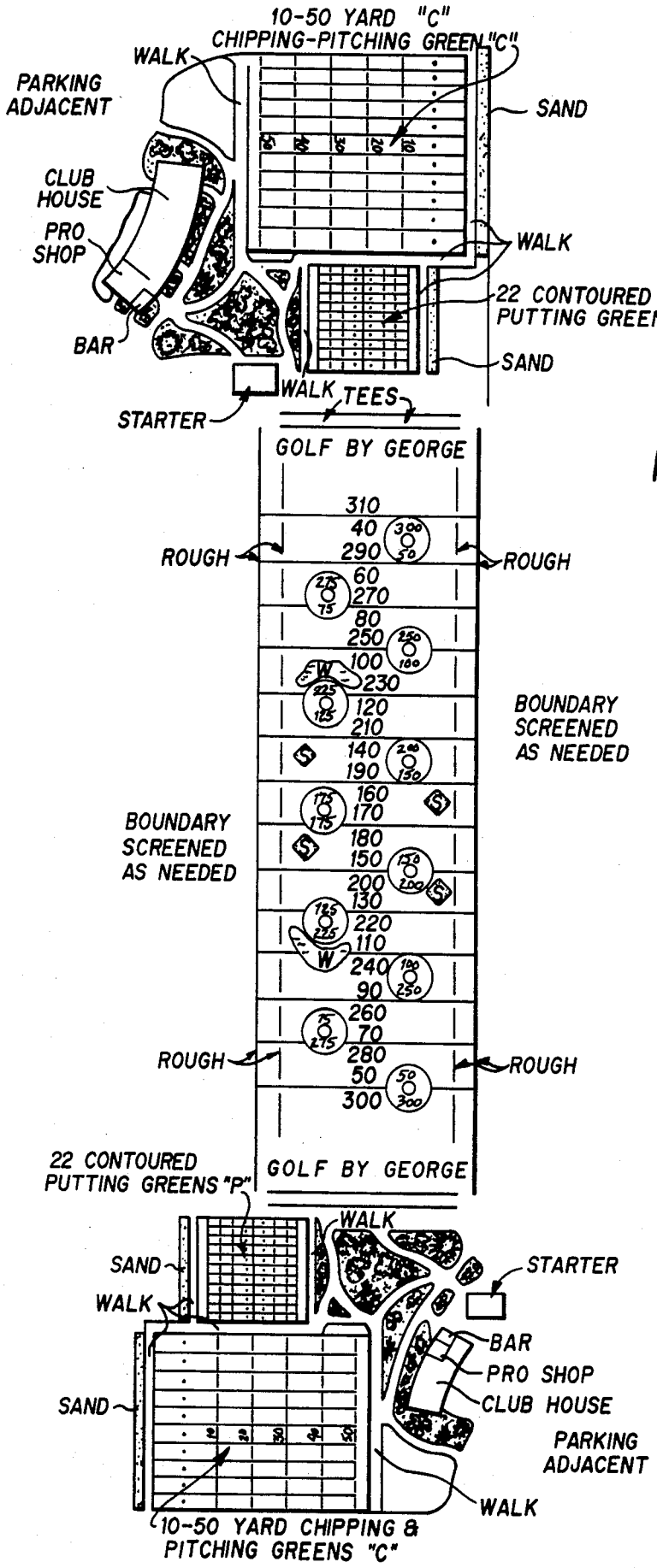
FIG. 9 is a top plan view of a double ended course incorporating the alternate embodiment of FIG. 8.

In another embodiment of this invention shown in FIG. 8, the layout of the chipping or pitching greens C and putting greens P may be seen as different, in that they are all straight narrow lanes. The chipping or pitching approach lanes and greens C are in the order of 70 yards in length including the sand, with 10 of the adjacent chipping or pitching approach lanes and greens located on approximately a 50 yard wide area, which allows approximately 5 yards of width for each chipping green. If, during fairway play, his ball hits a fairway sandtrap, he initiates his play from the sand located across the ends of the "C" lanes. Each of the 10 chipping or pitching lanes are marked off at 10 yard intervals from the pin, which allows each player to position himself at any correct distance from the chipping-pitching pin corresponding to the remaining distance after his last fairway shot. If, for example, the remaining distance is 43 yards, he positions himself at that distance in the lane to chip or pitch to the pin and putts out. The chipping green C may be level or contoured for interest.

In FIG. 8, approximately 22 putting lanes P are located adjacent to the chipping or pitching greens C. Each putting green is elongated, for example 14 yards long, including pin area, and 3 yards wide. Each putting lane is marked off at 10 foot intervals from its pin. Thus, each player who lands his ball on his fairway target green in fairway play may place a ball on one of the "P" putting lanes corresponding to the distance from the pin of his last fairway shot. This concept creates 22 individual putting lanes in approximately the area of two conventional putting greens, and provides eleven with sand trap approach play. Each putting green has its own hole so that there is no cueing of players as in the case of common practice greens found adjacent to the club house of most golf courses. The putting green P may be level or contoured. The putting green allows each of 22 players to simultaneously putt out at their own hole without interference.

The advantage of the configuration of FIG. 8 is that the chipping and putting functions which previously took the one entire end of the course for six chipping and pitching greens and two putting greens now requires only about two-thirds of the end for many more chipping or pitching greens C and putting greens P. This allows more players to play the course at the same time. Additionally, this allow room on the same space for a club house, pro shop, starter shop and other amenitites as well as some pleasant walk areas illustrated in FIG. 8 to the right of the chipping or pitching and putting greens.

With the elimination of possible tie-ups at the chipping and putting greens, this invention allows the tees to be more numerous and in fact to be of double or multiple level. The tee area designated 11 is shown with 22 tees and with a ramp of FIG. 8 to the roof area which may include an additional 22 tees. It is therefore possible to have a significantly greater number of players on the course at the same time without interference with each other.

Figure 10:
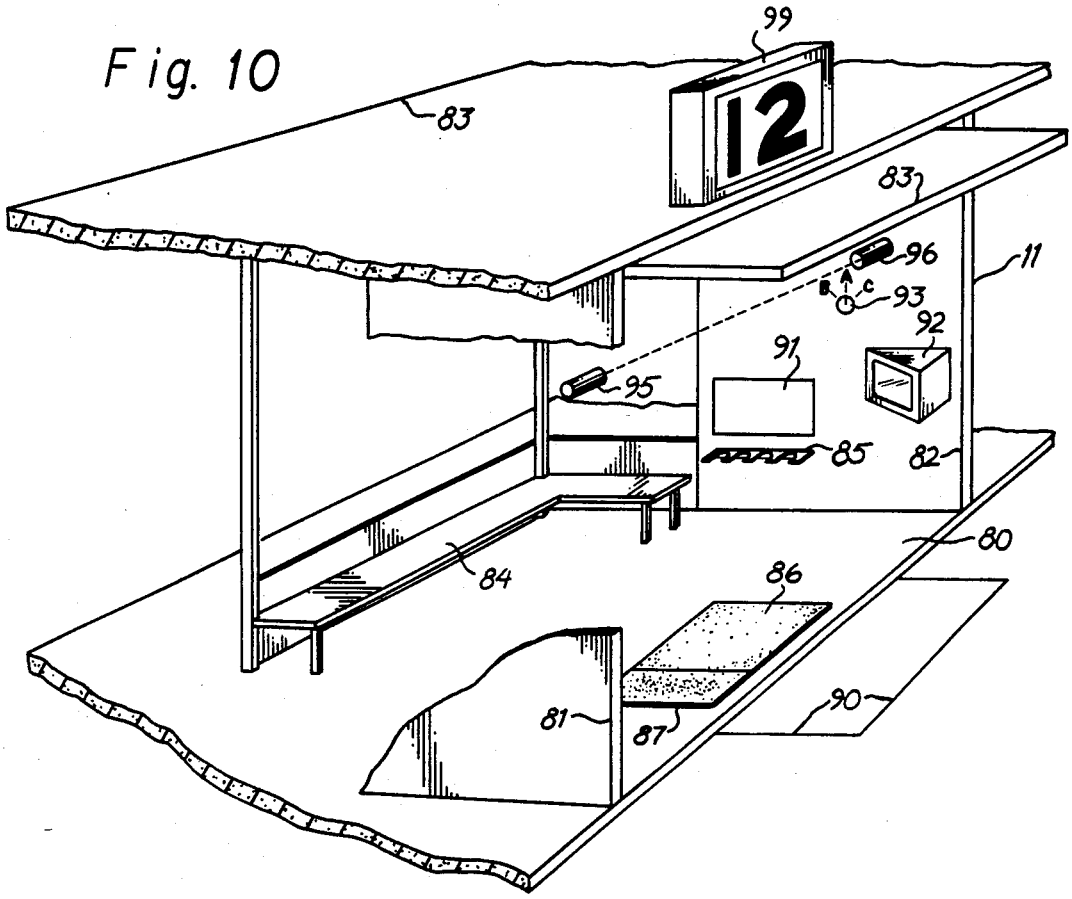
FIG. 10 is a perspective view of an alternate tee showing an enlarged illuminated number of the tee.
Figure 11:
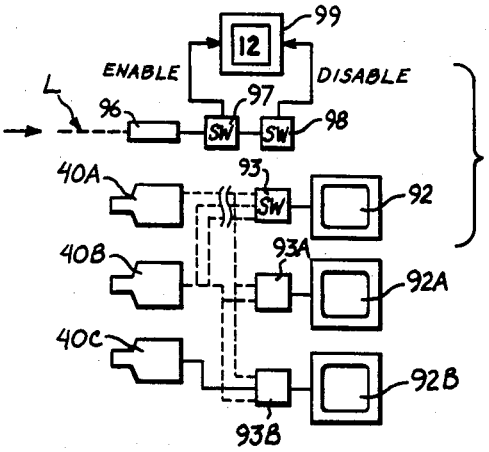
FIG. 11 is a block diagram of an alternate form of closed circuit TV camera selection device at the closed circuit monitor arrangement.

Most apparent in FIG. 8 are one or more support standards 200, approximately 50 feet in height, supporting three television cameras 40A–C, and located at or beyond the far end of the fairway, each directed toward the course and the tees 11. The three television cameras may be directed, one to left of center, one in center and one to the right of center, in order to give full coverage for the course. This arrangement of support standards and cameras is a rearrangement of this item in my co-pending application. In this case, the directing of the television cameras toward the field of play and particularly toward the tees gives additional aid to the player. This aid is more apparent by reference to FIG. 10 which is a perspective view generally like that of FIG. 4 above, but the tee generally designated 11 has, on its top or associated with it, directed toward the fairway, a large illuminatable sign 99 showing visible to said cameras, the number of the tee. In FIG. 10, the sign shows the number of tee 12. Each of the elements of the tee shown in FIG. 4 and also present in FIG. 11 are given the same designation as in FIG. 4. The difference in the embodiments of FIG. 11 and FIG. 4, in addition to the illuminated sign 99, is the fact that the photo cell light combination 95, 96 of FIGS. 10 and 11, when interrupted by the player's swing, serves to energize the illumination of the sign 99. So illuminated, the player, on completing his swing, can look at the television monitor 92 and immediately pick up and follow the flight of his ball, as viewed from the cameras 40A, 40B or 40C of FIGS. 8 or 13, as selected by his selector switch 93, and see his own tee number illuminated. This shows him immediately in his field of view, a close-up of the course, plus his ball in flight, plus his own tee as the originating point of the flight and final resting place of his ball in relationship with the course markings. After a period of time, such as 16 seconds, an automatic switch 98 in the circuit of FIG. 11 terminates the illumination of the tee indicator light 99. This arrangement is believed to be superior to the increase in the illumination of the entire field which could be distracting to players. In this case the overall field illumination remains substantially uniform while the source of each shot is pinpointed by illumination of its tee sign 99.

Now referring to FIG. 11, the photo cell 96, when the light beam L from light source 95 of FIG. 10 is broken by player's swing, operates the switch 97 to illuminate sign 99, and after a time delay switch 98 serves to reset or turn off light illuminated sign 99. The switch 98 is a timed light switch having a delay such as 16 seconds.

Figure 12:
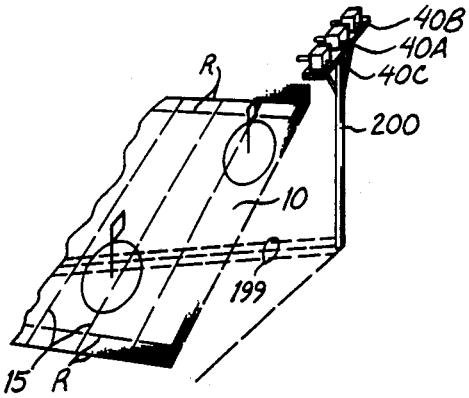
FIG. 12 is a fragmentary perspective view showing the closed circuit television cameras at the end of the course.

Now referring to FIG. 12, the three cameras 40A–C on support standards 200 are connected by cables 199, preferably underground, to the tee area 11 and to each of the individual monitors 92, where they are coupled via selector switches 93 located in each of the individual tees. This allows the player to select the particular camera he desires to use. Initially, automatically the monitor shows the view from the center camera, however, if the player hooks or slices and desires to see his ball when better viewed by either camera 40B or 40C, he may change to the other camera by moving selector switch 93. In any case the tee number sign 99 remains illuminated for the preset period, e.g. 16 seconds, regardless of which camera the player selects. Other tees with their own monitors are served by the same cameras 40A–C and respective switches 93-93A-93B.

Refer now to FIGS. 13–16 in which the television cameras 40 A–C are located on individual poles 200 A–C connected by cables 199 A–C to a switching control center 208 in which the switching controls of FIG. 11 are located.

Figure 15:
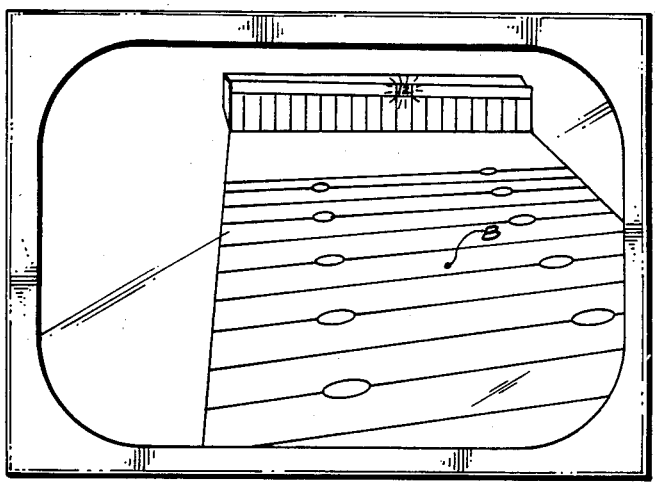
Figure 16:
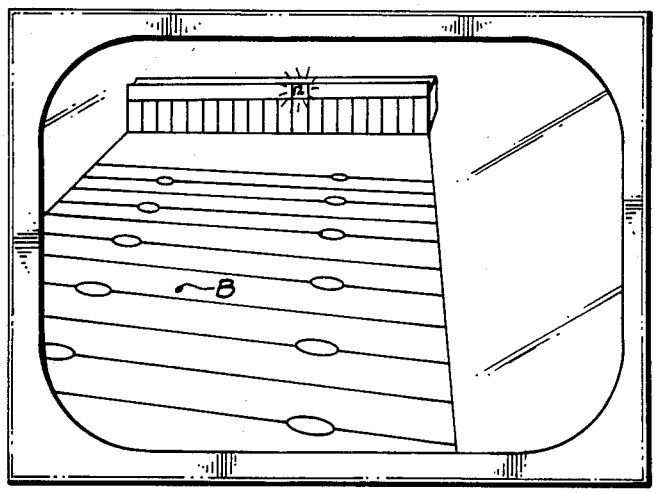

The course 10 has targets 16 and range lines 15 with a double directional marker so as to be visible directed by the player from the tee and indirectly as viewed by the television cameras 40 A–C at the opposite end. In this embodiment, the cameras are laterally displaced at the end to provide different views of the fairway as illustrated in FIGS. 14–16.

Figure 14:
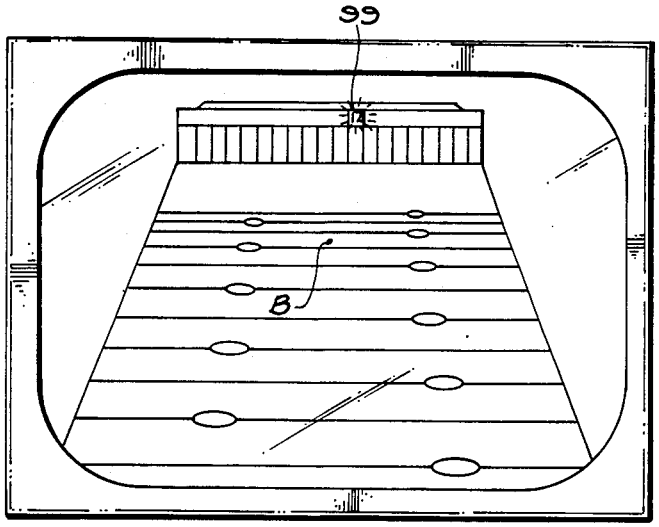
FIGS. 14–16 are three simulated views of the monitor views to the player as he selects different monitors.

In FIG. 14, the normal monitor view is shown in monitor 92 after a player in the tee No. 12 has completed his swing and his sign 99 is illuminated. His ball B is shown in flight straight down the fairway as seen by television camera 40A. If viewed on either other camera, camera 40B in FIG. 15 or camera 40C in FIG. 16, a slightly different perspective is present. Although viewing the ball in flight with the monitor requires visual acuity and practice. The fact that the cameras are located at the end of the course and the ball is approaching the cameras and is slowing, bouncing and rolling towards the camera, aids in tracking of the ball.

Figure 13:
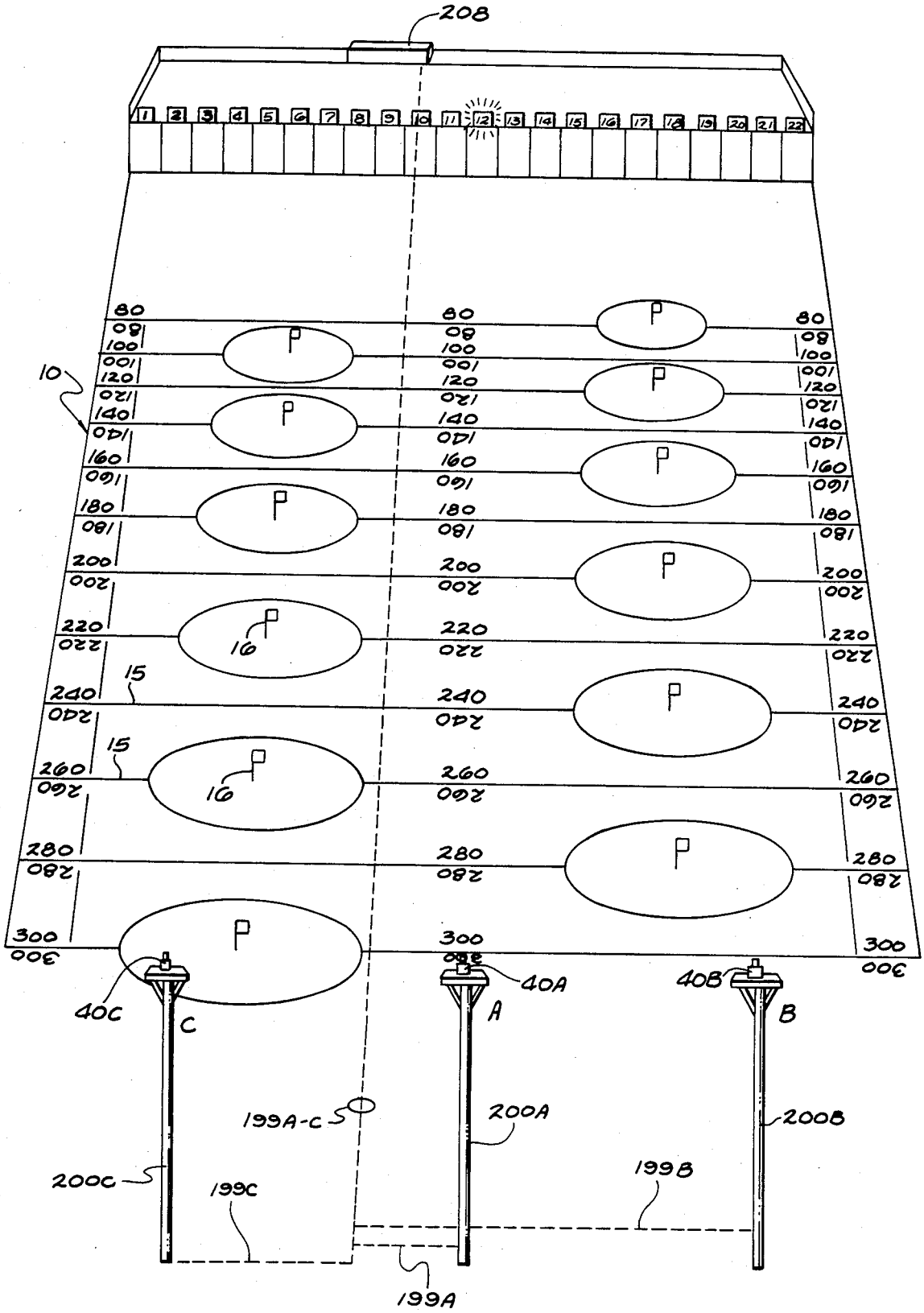
FIG. 13 is a perspective view of a compact golf course in accordance with this invention employing multiple television cameras on individual poles at the end of the course.

The use of multiple laterally displaced cameras as in FIG. 13 allows players in a large number of tees to have one camera in near direct line.

THE METHOD OF PLAY

The method of play in accordance with this invention involves the player or players making up a twosome, threesome or foursome, paying a fee with the starter and receiving a fixed number of balls, usually distinctively marked, and being assigned a tee reserved to him or them until their play is fully completed.

The player or players make a selection of the prominent course on which they would like to stimulate play. This is done from a placard of such courses showing the layout, par distances and par number of strokes related to each hole for each of the prominent courses. The player and his partners then note on their G-ByG scorecard the name of the prominent course and mark the par distances and corresponding par strokes for each hole related to the course they have selected. This also provides variation and interest by selecting a different prominent course each time a new 18 hole play is started.

EXAMPLE HOLE NO. 1 OF PEBBLE BEACH G&CC—385 YARDS

After teeing off, the golfer records the yardage he has advanced the ball on his first shot. He ascertains this with the aid of the closed circuit TV monitor located at this tee, and the location of his ball in relation to the marked off, horizontal yardage lines that are visible to him on the closed circuit TV monitor. Target greens and circles are not yet involved.

The yardage recorded must be that determined where the ball lies in relation to the horizontal yardage lines, at 20 yard intervals across the fairway. If his drive was a sharp slice to the right, he may have hit his ball actually longer, due to the angle, but he only records the yardage he has advanced the ball up the fairway. The added length he hit it off to one side is lost as a penalty for miss-hitting it. Example: His observed yardage for his drive was 170 yards, he noted the 170 yards on his scorecard and subtracted that from the 385 yards, leaving 215 yards for his second fairway shot.

All fairway shots are made from his tee which remains reserved to him and his playing partners until the round is completed.

For his second fairway shot, he selects the fairway target green (which now becomes involved in the play), which distance thereto from the tee, is at the closest yardage that is greater than the 215 yards. Therefore, the 225 yard target green would become his target for his second shot. He selects the appropriate club for that distance.

He then plays a second ball from his tee toward the 225 yard target green and observes with the aid of the closed circuit TV the yardage he has advanced the ball. (Again, this will be the yardage location where his second ball comes to rest between the horizontal yardage lines located across the fairway.) He may have hooked a long ball off to the left—but only records the yardage where his ball lies in relation to the yardage lines, this being the yardage his second shot has further advanced the ball directly forward.

Assume his second shot is 183 yards. He notes same on his scorecard below the 225 yards he previously noted and subtracts the 183 yards from the 225 yards, leaving a distance of 42 yards.

If he has missed his target green but has hit within 50 yards of it, (at the location around the hole) and if still off the green, he observes the yardage from that hole and notes that distance on his scorecard.

He then proceeds to the chipping-pitching greens "C" approach area.

He places either his own or an issued marked ball in the adjacent "C" approach area on one of the 2 sets of "yardage lines" at the location along the line that corresponds with the distance he has missed his target green. He then chips or pitches on to the "C" green and putts out.

If he has reached the fairway target green, he notes on his scorecard only the observed remaining distance in yards that the ball is from the pin.

He then proceeds to the "P" putting green, places either his own ball or a specially marked course ball on that noted yardage, or as measured in 3 foot strides from a hole on the "p" putting green. He then putts out and records his total strokes for that hole on his scorecard.

He then walks back to the tee reserved for him and plays the remaining holes in like manner.

All distances are measured in yards per the course markings or 3 foot strides.

If, during fairway play, he lands in a fairway sand trap, he marks "S" on his scorecard next to the noted stroked distance when he went into the trap. He continues his fairway play as though he had not gone into the trap. However, after he has reached within 50 years of his fairway target green but missed it, he proceeds to the chipping-pitching greens "C" and places his or an issued ball at his last remaining yardage from the chipping-pitching green pin. He must then chip or pitch into the trap that is adjacent to the chipping-pitching green "C", play from the trap onto the chipping-pitching green "C" and putt out.

If he has an "S" during his fairway play and does not miss his target green, he must first toss his ball into the sand trap adjacent to the putting green "P" and play out onto the putting green "P", putt out and record his total strokes for that hole.

If he misses his 'Target Green' and lands in the adjacent sand trap then at the putting green 'P' he must first toss his ball into the sand trap at 'P' and play out onto the putting green 'P' and putt out.

When a golfer's ball lands in the rough, he plays his next ball at his tee off of the rough pad.

If the ball lands in a watertrap, he marks a small "w" on his scorecard next to the noted stroked distance and counts one stroke penalty.

When the ball hits the side boundary, he marks a small "b" on his scorecard next to the noted stroked distance for that hole and he takes a two stroke penalty.

When his fairway shot sends the ball into the rough, the player marks a small "r" on his scorecard and plays his next shot from the 'rough' pad at his tee.

Following this procedure, the full round of golf proceeds for each player.

Play in my improved course is facilitated using the improved scorecards shown in FIGS. 17, 18 and 19 as well as the record of improvement card shown in FIGS. 20 and 21. The scorecard of FIGS. 17 and 18, front and back respectively, show how the player records the accurate distance of each shot, his chipping or pitching performance and his putting. There is also room in each square for indicating the club used. This is a factor seldom if ever recorded and one which can be important in analyzing the player's actual performance.

FIG. 19 shows in the example scorecard for simulated play of the first 9 holes of Pebble Beach with the par and distance for each hole indicated, clubs used, greens hit in regulation, yardage gained, putts taken and total strokes and penalties. It is possible by using the score cards of this invention to analyze the round of golf carefully and much more precisely than heretofore possible with the conventional score cards.

Over a period of time the performance of the golfer should improve, and the record card of FIGS. 20 and 21 allows a careful analysis of the trend in the golfer's performance over a period of months. The chart analyzes the performance with each of the different clubs as well as the putting performance, and the longest distance hit and the average distance with each of the clubs. The player therefore, in analyzing his play using the golf course of this invention, is able to record it more precisely using accurate shot observation provided through the closed circuit TV, the scorecard and method of this invention.

The above described embodiments of this invention are merely descriptive of its principles and are not to be considered limiting. The scope of this invention, instead, shall be determined from the scope of the following claims, including their equivalents.

What is claimed is:

1. A compact golf course with closed circuit television aid to golfers comprising:

a compact golf course including a plurality of tees directed toward a common fairway area having a number of range markers and target greens for indicating the distances from the tees;

at least one closed circuit television camera located down range of said course and directable toward the fairway and said tees;

a television monitor at each of said tees and coupled to said television camera;

said tees including an illuminatable tee identifier sign associated with each of said tees and directed toward said common fairway area and visible to said closed circuit television camera; and means at said tees for energizing the illuminatable tee identifier to provide of the player's tee as a player drives a ball therefrom whereby the television camera detects the play actuated illuminated tee identifier and the player can view on a closed circuit TV monitor at his tee the origin of flight of his ball and so follow the flight of the ball to where it rests in relation to the range markers, where with the aid of the closed circuit TV monitor, he can clearly see a closeup of the accurate distance he has hit the ball.

2. The combination in accordance with claim 1 in which said energizing means is responsive to a players swing.

3. The combination in accordance with claim 1 wherein said play actuated illuminatable indicator is a sign which bears the number of the player's tee visible to the closed circuit TV cameras.

4. The combination in accordance with claim 1 including a plurality of television cameras, each directed to cover a particular area of the common fairway area, and selector switch means at said tees for selecting which camera is to be connected to the monitor at said tee.

5. The combination in accordance with claim 4 wherein said cameras are directed toward overlapping areas of said fairway common area.

6. The combination in accordance with claims 1 or 4 in which said camera or plurality of cameras are positioned at the end of said common the fairway area.

7. The combination in accordance with claim 1 including at least one water hazard in which said hazard is of shallow depth but includes a single maximum depth location and tapered bottom from other locations is provided whereby balls landing in said water hazard have a tendency to roll to such maximum depth location for easy recovery, or ball recovery may be made by standard mobile retrievers rolling through the hazard to easily recover the balls.

8. A water hazard in accordance with claim 7 wherein the bottom is of concrete.

9. The combination in accordance with claim 7 including means for circulating the water in said hazard.

10. The combination in accordance with claim 1 including plurality of generally parallel lane putting greens with at least one sand trap adjacent to the putting greens.

11. The combination in accordance with claim 10 wherein said generally parallel putting greens are in the order of three yards wide and in the order of 14 yards long whereby a large number of greens may be constructed in an area normally adequate for two greens.

12. In combination with claim 1, a multiple lane chipping or pitching lane approach and putt out series with provision for sand trap play which makes it possible to provide 11 of said chipping and pitching lanes in a condensed area.

13. The combination in accordance with claim 1 including a scorecard having positions thereon for the player to record the efficiency and improvement of use of each playing club in addition to normal scoring.

* * * * *